United States Patent [19]

Cappuccilli

[11] 4,039,080

[45] Aug. 2, 1977

[54] DOSAGE INDICATING PILL TRAY

[76] Inventor: Joseph Anthony Cappuccilli, 404 Oak St., Syracuse, N.Y. 13203

[21] Appl. No.: 669,644

[22] Filed: Mar. 23, 1976

[51] Int. Cl.[2] ..... G09F 9/00; B65D 1/36; B85D 85/56

[52] U.S. Cl. ..... 206/534; 116/121; 206/459; 206/538; 206/561

[58] Field of Search ..... 206/538, 539, 534, 72, 206/459, 561; 116/121

[56] References Cited

U.S. PATENT DOCUMENTS

| | | | |
|---|---|---|---|
| 1,717,060 | 6/1929 | Mottayaw | 206/72 |
| 3,225,913 | 12/1965 | Lee | 206/534 |
| 3,618,559 | 11/1971 | Moe | 116/121 |

*Primary Examiner*—William T. Dixson, Jr.
*Attorney, Agent, or Firm*—Charles S. Mc Guire

[57] ABSTRACT

A tray having individual compartments for holding pills, capsules, or similar solid medication, each compartment being rectangular in plan view and arranged in a rectangular format or seven columns and a plurality of rows. The tray may be loaded with a week's medication for an individual patient with indicia adjacent each column indicating the day of the week, and indicia adjacent the rows indicating the time of day that the medication in each compartment is to be taken. A lid or cover cooperates with the wall means defining the individual compartments to mutually isolate the compartments when in the closed position. The inner surfaces of the compartments are preferably rounded in at least one plane of ease of withdrawing medication therefrom.

2 Claims, 3 Drawing Figures

DOSAGE INDICATING PILL TRAY

BACKGROUND OF THE INVENTION

The present invention relates to dosage-indicating trays or similar holders for individual solid medications such as pills or capsules.

Many forms of dispensing containers and other holders for pills, and the like, have been proposed and commercially introduced. In general, such containers have been relatively complicated or expensive when intended for holding a plurality of different medications to be dispensed at various times over a period of several days. For example, separate fabrication and assembly of a number of relatively movable parts is required in many dispensing pill holders. Others are limited in the size or type of medication which they are designed to hold, and in some the configuration of the individual pill-holding compartments makes manual withdrawal of the medication difficult.

It is a principal object of the present invention to provide a pill tray of extremely simple and inexpensive design capable of holding a plurality of pills or capsules in each of an array of compartments marked with the day and time each dosage is to be taken.

A further object is to provide a holder for solid medications having a simple layout of individual compartments for easy identification of, and ready manual access to, each compartment.

Another object is to provide a pill tray having individual compartments for holding a week's supply of medication with an internal configuration which facilitates easy withdrawal of the contents of each compartment.

Other objects will in part be obvious and will in part appear hereinafter.

SUMMARY OF THE INVENTION

In accordance with the foregoing objects, the invention comprises a pill tray which may be conveniently and economically fabricated from injection molded plastic, or the like, in only two pieces, a base and a cover. The base is rectangular in outline and includes medial wall portions defining an array of individual compartments. The compartments are square or rectangular in plan view and have bottom walls which are rounded in at least one cross sectional direction. The upper edges of the wall portions lie in a common plane so that the flat cover member, hingedly attached to the base, contacts these edges when closed. The compartments are large enough that each may hold a plurality of pills or capsules of normal size, and are arranged in a rectangular array of seven columns with a plurality of rows in each column. Indicia on surfaces adjacent the columns and rows indicate the days of the week and times of the day that the medication within each compartment is to be taken.

DETAILED DESCRIPTION OF THE PREFERRED EMBODIMENT

Figure 1:
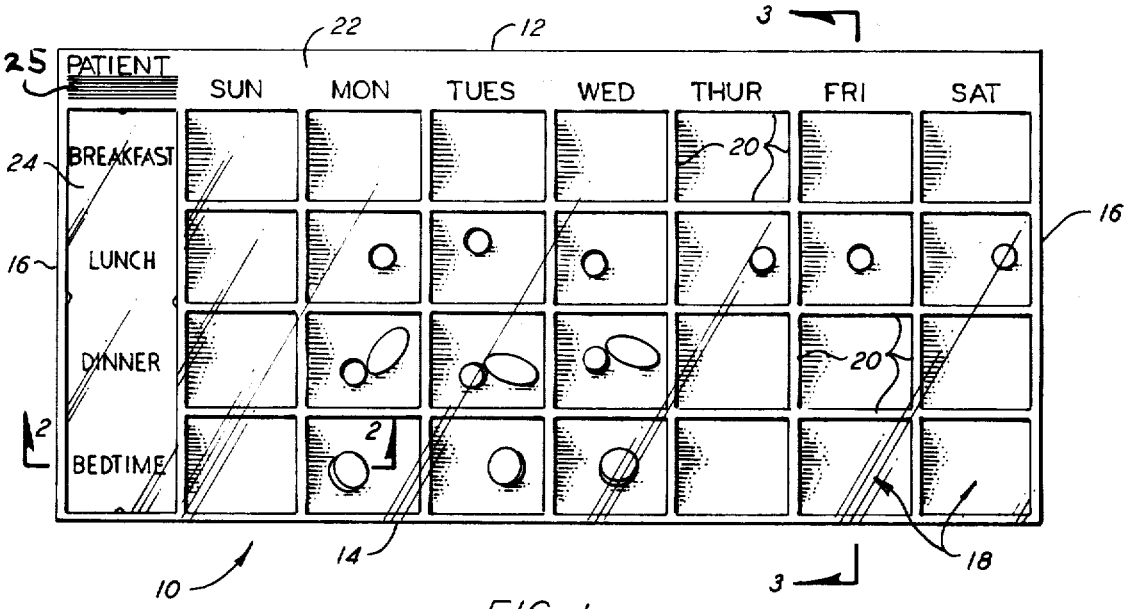
FIG.1 is a plan view of the base of the pill tray.
Figure 2:
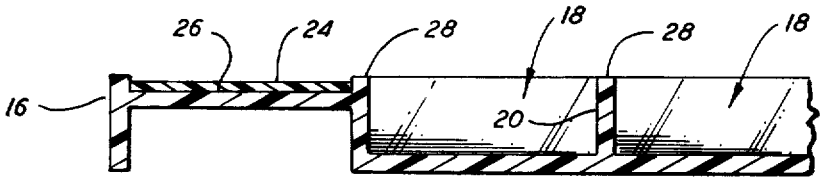
FIG. 2 is an enlarged, fragmentary elevational view in section on the line 2—2 of FIG. 1.

Referring now to the drawing, the pill tray comprises a unitary base element, indicated generally by reference numeral 10, having a rectangular outline in plan view with upper and lower edges 12 and 14, and side edges 16. The top side of base 10, shown in FIG. 1, is divided into a plurality of individual compartments 18 by walls 20. Compartments 18 are square in plan view and are arranged in a rectangular format of seven columns, each column including four rows. Surface 22 is provided between upper edge 12 and the top of the uppermost row of compartments 18 and is inscribed with indicia corresponding to the days of the week adjacent the seven columns. Surface 24 is provided on the base between the left side edge 16 and the first column of compartments 18, and is inscribed with indicia corresponding to various times of the day. As illustrated, the indicia on surface 24 corresponds to the three meal times and bedtime, these being commonly designated times for taking medication. However, it may be desirable to indicate particular hours of the day, or other indications of the time for taking medication. For this reason, surface 24 may be provided on a separate sheet of paper or other material secured to this portion of base 10, as indicated in FIG. 2 by reference numeral 26, to allow erasure of the indicia thereon and selective indication of the times adjacent the rows of compartments 18. Also, sheet 26 may be printed on one side, with indicia such as shown in FIG. 1, and optionally reversible to place the opposite side, which may be selectively inscribed, facing upwardly. Also, erasable area 25 is provided for inscribing the patient's name.

Figure 3:
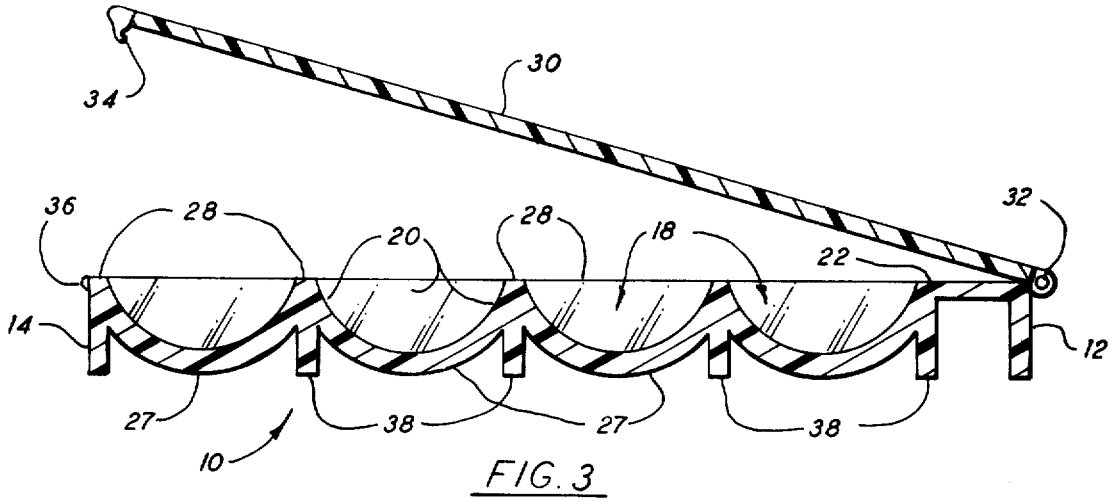
FIG. 3 is an elevational view of the base and cover taken on the line 3—3 of FIG. 1.

As best seen in FIG. 3, bottom walls 27 of compartments 18 are rounded to extend continuously between walls 20 which separate the rows of compartments 18. With this configuration, pills or other medication within the compartments may be withdrawn more easily since there are no corners or edges to interfere with movement of the pills. This is particularly desirable when the tray is used by elderly or arthritic patients.

Upper surfaces 28 of walls 20 lie in a common plane, and no portion of base 10 extends above this plane. Cover 30 is attached to base 10 by hinge 32, or other convenient means which allow movement of the cover between covering and uncovering positions with respect to the upper, open sides of compartments 18. Cover 30 is preferably of the same rectangular shape and size as the outline of base 10 and is essentially flat so that its lower surface rests upon upper surfaces 28 of walls 20 when cover 30 is in the closed position. Thus, cover 30 serves to mutually isolate compartments 18 when in the closed position, and any medications within the various compartments cannot be dislodged. Edge 34 of cover 30 cooperates with lip 36 on edge 14 of base 10 to form a snap-fit catch.

Although sufficient rigidity may be provided by a single, peripheral wall around the sides of base 10, additional support may be desirable in the form of intermediate walls 38 on the bottom side.

From the foregoing it is evident that the pill tray provides a convenient and efficient means for storing medication in a manner allowing ready access and clear indication oa the times at which each dosage is to be taken. The tray is particularly effective to insure proper dosages at varying times, such as alternate days, with several types of medication.

What is claimed is:

1. A tray for holding prescribed dosages of pills, or the like, in compartments indicating the day and time such dosages are to be taken, said tray comprising:

a. a unitary base portion rectangular in plan view and having:

i. a first, rectangular, planar surface extending across said base portion from one side edge to the other and adjacent the top edge thereof;

ii. a second, rectangular, planar surface extending from the lower edge of said first planar surface to the lower edge of said base portion and adjacent one side edge thereof; and iii. a rectangular array of individual compartments extending between said lower edges of said first planar surface and said base portion, and between the interior side edge of said second planar surface and the opposite side edge of said base portion;

b. said individual compartments each being of equal size, rectangular in plan view, arranged in seven columns and a plurality of rows;

c. said first planar surface bearing indicia adjacent said columns, labeling each with one of the days of the week;

d. said second planar surface being indicia adjacent said rows labeling each with a general time of day;

e. said individual compartments being formed of two planar, parallel side surfaces and a continuous bottom surface extending between said side walls and between upper and lower edges, said bottom surface being curved about a constant radius between said upper and lower edges;

f. said side and bottom surfaces of adjacent compartments being separated by wall means each having upper surfaces lying in a substantially common plane with said first and second planar surfaces; and g. a flat cover attached to said base portion for hinged movement between a covering position, wherein one surface thereof lies in said common plane, and an uncovering position, allowing access to said compartments.

2. The invention according to claim 1 and further including additional indicia in the area of said first planar surface adjacent said second planar surface identifying the patient for whom medication in said tray is prescribed.

* * * * *